United States Patent [19]

Chevalier

[11] Patent Number: 4,771,757

[45] **Date of Patent: * Sep. 20, 1988**

[54] CLIP WITH BLOCKED CHAMBER STOP MECHANISM FOR SUPPLYING PROJECTILES GUN

[75] Inventor: Martin A. Chevalier, Hudson, Wis.

[73] Assignee: BallistiVet, Inc., White Bear Lake, Minn.

[ * ] Notice: The portion of the term of this patent subsequent to Aug. 2, 2005 has been disclaimed.

[21] Appl. No.: 13,702

[22] Filed: Feb. 12, 1987

[51] Int. Cl.[4] ..... F41C 25/00

[52] U.S. Cl. ..... 124/51 R; 42/15; 604/891.1

[58] Field of Search ..... 124/45, 51 R, 53, 72; 206/3; 102/281, 282, 512; 89/33.03, 33.14, 35.01; 42/1.01, 1.02, 1.05, 67, 70.02, 15; 604/891

[56] References Cited

U.S. PATENT DOCUMENTS

| | | | |
|---|---|---|---|
| 1,451,339 | 4/1923 | Kottas | 42/1.02 |
| 1,723,692 | 8/1929 | French | 89/35.01 |
| 4,004,565 | 1/1977 | Fischer | 124/45 |
| 4,004,566 | 1/1977 | Fischer | 124/51 R |
| 4,483,088 | 11/1984 | Tussing | 42/1.05 |

FOREIGN PATENT DOCUMENTS

| | | | |
|---|---|---|---|
| 648817 | 12/1928 | France | 42/70.02 |
| 542727 | 2/1942 | United Kingdom | 42/15 |

*Primary Examiner*—Richard C. Pinkham
*Assistant Examiner*—Mark S. Graham
*Attorney, Agent, or Firm*—Merchant, Gould, Smith, Edell, Welter & Schmidt

[57] ABSTRACT

An improved clip (15) and method for supplying hygienic projectiles (22) to a ballistic implant gun (10) is disclosed. The clip (15) includes a plurality of cylindrical chambers (20) which each contain a projectile or bioligical bullet (22). The clip (15) also includes indexing means (27) which automatically advance the clip (15) transversely of the gun's housing to supply a projectile (22) to the gun (10) after the preceeding projectile has been discharged. The clip (15) further includes a stop mechanism (14) which notifies the user when all of the bullets (22) have been discharged. This stop mechanism comprises a blocked chamber (14) located at one end of the clip (15) which contains a plurality of tabs (30) therewithin. After the final bullet has been discharged, the blocked chamber (14) can be advanced to align with the gun's firing chamber. When the bolt of the gun hits and is stopped by the blocked chamber (14), the gun (10) is prevented from further operation until the user replaces the empty clip (15) with one containing additional projectiles (22).

14 Claims, 1 Drawing Sheet

FIG. 1
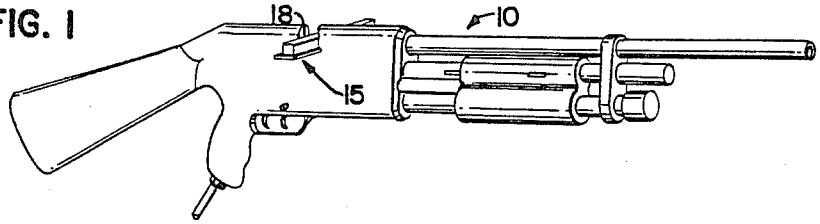
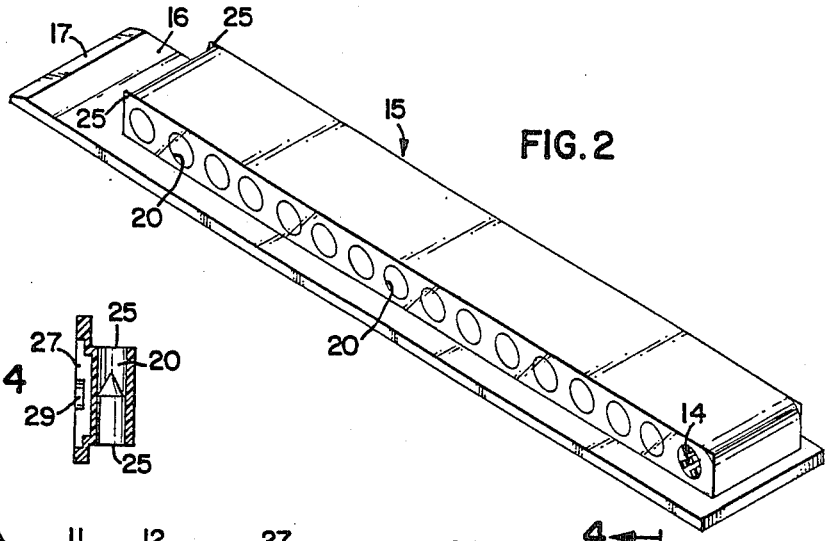
FIG. 2
FIG. 4
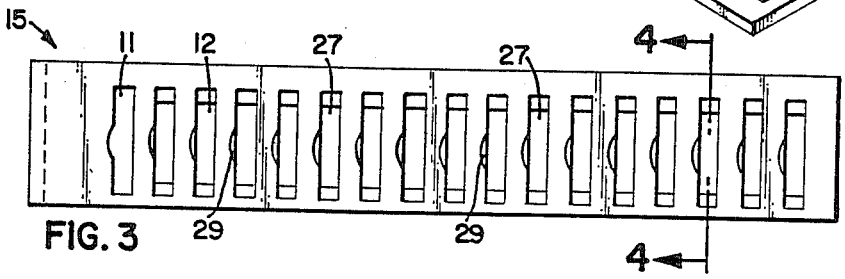
FIG. 3
FIG. 5
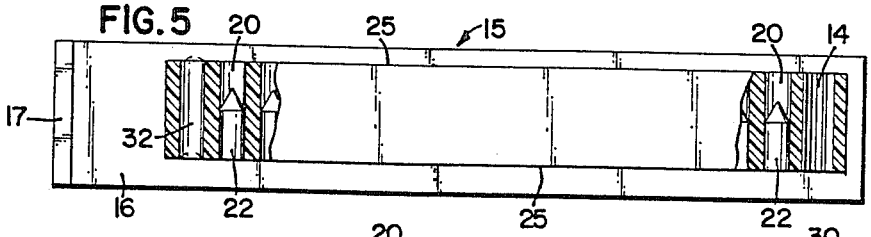
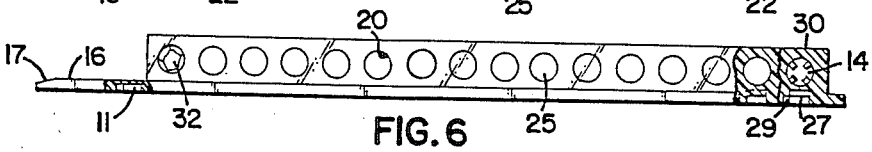
FIG. 6

CLIP WITH BLOCKED CHAMBER STOP MECHANISM FOR SUPPLYING PROJECTILES GUN

FIELD OF THE INVENTION

The present invention relates to an improved clip for supplying hygienic ballistic implant projectiles to a gun for implanting the projectiles into animals. More particularly, the present invention relates to an improved clip having a blocked chamber for automatically stopping the operation of the gun when the clip is empty.

BACKGROUND OF THE INVENTION

The traditional method for inoculating animals is to use a needle and syringe. This process is time-consuming and labor-intensive, because the animals must be herded and sometimes separated or restrained. Also, the needle and syringe method is stressful for both the user and the animal. Further, the protection level achieved by the needle and syringe method is sometimes very low. Often, the user inadvertently pushes the syringe's plunger before the needle is completely within the animal or as it is being withdrawn from the animal. As a result, there are potential problems of cross-contamination and inaccurate dosage. In addition, there is a danger of contamination when a first contaminated animal is administered with the inoculating device, and the same device is then used on successive animals.

A convenient, inexpensive and safe way to administer biologicals and pharmaceuticals to animals is to utilize projectiles, each projectile containing a separate dose of a biologically active material for inoculation. Each projectile is fired from a gun at some distance from the animal. The projectile or biodegradable "bullet" is implanted into the animal's muscle, where it dissolves and is carried through the animal's system during the next hours.

The biodegradable projectiles are advantageous for several reasons. Each one contains the necessary, accurate dosage depending upon the animal and the inoculation project. Each projectile or bullet can be filled with mixtures of multiple vaccines, bacterins or pharmacuetical products. This eliminates the need for mixing and measuring out in the field. The bullets can also be stored for an indefinite period of time, especially if they are refrigerated. They are convenient to use, store, handle and ship. The biologically active material within the projectiles is a freeze-dried product. In this form, contamination and loss of potency are prevented. Such projectiles are described in patents assigned to the assignee of this application and are identifed as Drake and Paul, U.S. Pat. No. 3,948,263, issued Apr. 6, 1976; and Krogseng and Paul, U.S. Pat. No. 3,982,536, issued Apr. 28, 1976.

To store these bullets or projectiles, a clip containing a plurality of cavities of chambers may be used, each chamber containing one projectile. This type of clip features a rupturable seal on each open end of each chamber, to protect the contents from impurities, providing a hygienically packaged projectile. Another feature of this type of clip is an indexing means which automatically advances the clip so that successive chambers, each containing a projectile, are automatically aligned with the bore of the gun. Each time the gun is fired and cocked, the clip automatically advances and chambers a new projectile. Typically, this type of clip contains ten chambers which hold ten projectiles.

This clip is described in a patent application assigned to the assignee of this application, and is identifed as Fischer and Gould, U.S. Pat. No. 4,004,565, issued Jan. 25, 1977. The indexing mechanism associated with the gun is decribed in patent application identified as Fischer, U.S. Pat. No. 4,004,566, issued Jan. 25, 1977.

However, a user of the above type of clip is often unaware when the clip becomes empty and contains no more projectiles. There is no physical indication to tell the user that he is firing nothing but air. The gun continues to fire, and the bolt of the gun continues to project through the last empty chamber, until the user finally realizes that there is no longer firing any projectiles. The only way to prevent this situation is to count each time the gun is fired, a practice which is often inconvenient and ineffective. When the user discovers that the clip is empty, he often does not know how many animals have been inoculated and how many have not. The animals then have to be individually sorted out, or the animals who escaped inoculation are simply left without the biological or pharmacuetical product. As a result, there is a potential for a cross contamination by the animals which have not been inoculated.

The present invention solves this problem associated with currently available clips, as well as many problems associated with the traditional needle and syringe method.

SUMMARY OF THE INVENTION

The present invention relates to an improved clip and method for supplying hygienic projectiles to a ballistic implant gun. The clip includes a plurality of cylindrical chambers each of which contains a projectile or biological bullet. The clip also includes indexing means which automatically advances the clip transversely of the gun's housing to supply a projectile to the gun after the preceding projectile has been discharged. The clip further includes a stop mechanism which notifies the user when all of the bullets have been discharged. This step mechanism comprises a blocked chamber located at one end of the clip. The blocked chamber contains a plurality of integral tabs therewithin which serve as a stop. After the final bullet has been discharged, the blocked chamber is advanced to align with the gun's firing chamber. When the bolt of the gun hits and is stopped by the blocked chamber, the gun is prevented from further operation until the user replaces the empty clip with one containing additional projectiles.

The present invention is particularly advantageous in that it provides an effective stop mechanism to prevent firing of the gun when there are no more biologically active projectiles remaining in the clip. When the gun is cocked after the last bullet or projectile has been fired, the clip advances so that the stop mechanism is aligned with the gun's firing chamber. When the bolt hits the stop the gun is simply unable to operate. This effectively notifies the user when another clip must be loaded into the gun, so that no animals escape inoculation.

A still further advantage of the stop mechanism or blocked chamber of the clip of the present invention is that it has substantial structural integrity. There is little or no possibility that the bolt can extend into the blocked chamber. If for some reason this did occur, the user would be immediately aware of it and would know that a new clip should be replaced into the gun.

An additional advantage of the present invention is that the clip contains 15 chambers, rather than the ten-chamber conventional clip. This allows the user to implant projectiles in more animals before the gun must be reloaded and reduces the number of times that the gun must be reloaded. As a result of the additional number of chambers, production costs per chamber and per projectile are reduced.

Another advantageous feature of the present invention is that the implant projectiles are discharged from the gun at some distance from the animal. There is therefore no need to capture, corral, or otherwise restrain the animal during inoculation. This results in a savings in time, labor and money. Further, there is no need to touch or get near the contaminated animal which may have a highly contagious disease.

A further advantage of the clip of the present invention is that is it adaptable for use with the projectiles or bullets discussed above. The clip is refrigeratable to maintain the biologically active material in a stable form until the inoculation occurs. Each implant projectile is individually sealed in the clip and is not touched after it is originally packaged. The projectiles are thus protected from contaminants such as dirt and bacteria.

Still another advantage of the present invention is that the clip allows the user to fire the desired number of bullets, remove the clip, and then store the clip and the remaining bullets until such time when the remaining bullets are necessary. The removal of the clip is permitted without distrubing the hygienic packaging of the remaining implant projectiles. When all the projectiles have been used, the clip is disposable, which is convenient for the user.

For a better undertanding of the invention, and the advantages obtained form a further part hereof, and to the accompanying descriptive matter, in which there is illustrated and described a preferred embodiment of the present invention.

BRIEF DESCRIPTION OF THE DRAWINGS

In the Drawings, reference numerals and letters indicate correpsonding parts throughout several views.

FIG. 1 is a perspective view of a gas-operated gun and the clip of the present invention;

FIG. 2 is a perspective view of the clip of the present invention;

FIG. 3 is a bottom view of the clip of FIG. 2;

FIG. 4 is a sectional view taken in line 4—4 of FIG. 3;

FIG. 5 is a plan view of FIG. 2 with portions thereof in section; and

FIG. 6 is a side view of the clip of FIGS. 2–5 showing the clip with portions thereof in section.

DESCRIPTION OF THE PREFERRED EMBODIMENT

Referring now to the drawings, the gun, generally designated 10, is adapted to receive the clip of the present invention, generally designated 15, to permit implantation of a ballistic projectile 22 with sufficient velocity to penetrate the epidermal covering of a living animal body and lodge totally within the body.

The clip 15 of the present invention is preferably made from an injection plastic molding process. It includes a web 16 which is generally rectangular in shape having at one end a tapered edge 17 to facilitate insertion of the clip into a transverse guide passage 18 in the housing of the gun 10. On one surfgace of the web 16 and molded integrally therewith are a plurality of transversly positioned, equally spaced, cylindrical chambers 20 having parallel axes. In the preferred embodiment, there are fifteen "working" chambers 20, each containing a projectile, and a blocked chamber 14, which acts as a stop mechanism, as explained below. Each of the chambers 20 has opposite open ends and is formed with a connected wall structure to make the clip 15 more rigid. The chambers 20 are positioned in a row along the web. One end of each chamber 20 is closer to one edge of the web 16 than the opposite end for purposes of registration with the guide passage 18 in the housing of the gun 10. Also, one end of the row of chambers 20 is spaced from the tapered edge 17 to provide a tongue on the clip 15.

Within each of the working chambers 20 is a ballistic implant projectile or bullet 22. The projectile 22 comprises a conical nose and annular walls defining a generally cylindrical body which may have a cavity containing the biologically active material. The projectile 22 can be made of any sufficient force to penetrate a living animal body and which will not shatter upon impacting and entering the body.

Any of the numerous biomedically approved plastics can be used with advantage and can be selected from among those which are either soluable or insoluable in the animal body. Exemplary of useful insoluable materials are the synthetic organic polymers such as as the polyolefins, e.g., polyethylene and polypropylene; polysioxane; polyamides, such as nylon; fluorinated hydrocarbon resins; ABS polymers (acrylonitrile butadiene-styrene polymers) and the like. A suitable class of polymers which are soluable in animal bodies, e.g., cattle, are the cellulose derivatives such as hydroxypropyl cellulose, available commercially from the Hercules Powder Co. under the trademark "KLUCEL". The use of soluble projectiles is particularly advantageous, since after implantation, the projectile will be solubilized in and eliminated from the animal's body, eliminating the need to retrieve the projectile 22.

The projectile 22 can be a 20 or 25 caliber projectile, and the projectile 22 can be loaded with the desired dose of biologically active material. The biologically active material may include antigens, tranquilizers, vitamins, narcotics, etc. Bacterial cells or extracts may be added to the anitgen preparation as adjuvants to provide an increased immune response. Narcotics may be administered to narcotize the animal.

On the bottom surface of the molded structure are a plurality of spaced, transversely extending recesses 27. The recesses 27 are indexing means. The recesses 27 are positioned in corresponding spaced relation to the chambers 20 for positioning a chamber 20 in alignment with the bore of the gun. There is one more recess 11 than there are chambers 20 to index the clip 15 initially in the gun 10.

Each of the recesses 27 includes a wall which forms a rectangularly shaped portion 12. The leading edge wall of each rectangular recess 27 is provided with a radius portion 29. The clip 15 is sequentially advanced transversely of the housing of the gun 10. The rectangular portion 12 of the clip 15 receives a spring-biased clip retainer or detent to hold the clip 15 in place. The radius portion 29 of the clip 15 receives a pawl which advances the clip sequentially from one chamber 20 to the next.

Each of the chambers 20 is sealed by a mechanically rupturable seal 25 at each end to protect and aseptically package the projectile from contaminants such as dirt, bacteria, etc. In the preferred embodiment, a sealing film 25 is placed along the open ends of the chambers 20. The sealing film 25 is bonded to the clip at each of the open ends of the chambers to individually seal each chamber 20 at each end. The sealing film 25 is preferably a laminate of 0.5 (0.254 mm) mil polyester and 1.5 mil polyethylene. The sealing film 25 is preferably heat sealed to the molded clip structure 15 to form an impermeable bond around each chamber opening. The clip 15 is preferably formed of a translucent high density polyethylene, permittiing the heat sealing of the film thereto.

If it is desired that the chambers 20 be hermetically sealed to exclude penetration by gases and moisture, the seal 25 should include an impermeable material such as heat sealable aluminum foil, and the clip 15 should be made of a plastic impermeable to gas and moisture, e.g., a polyformaldehyde resin. The clip 15 alternatively could be formed of injection moldable polyolefins or polyamides, and other sealing films may be used.

In operation, when the pump of the gun 10 is reciprocated, the motion of the reciprocation of the breechblock causes the bolt (not shown) to withdraw from the clip 15; the hammer to cock; an index arm or lever to reciprocate a pawl and index the clip 15; and the bolt to force the next bullet through the seal 25 and into the firing chamber of the gun 10. The ballistic projectile or bullet 22 is then ready to be "shot" or launched upon pulling the trigger.

The bolt in the breech of the gun penetrates the sealing means at one end of a chamber 20 which is aligned with the bore of the gun 10. The bolt then engages the projectile 22, forcing it to rupture the seal 16 at the opposite end of the chamber 20, and the bolt extends through the chamber 20, forcing the projectile 22 into the bore of the gun 10. FIGS. 5 and 6 illustrate a clip 15 where the sealing film 25 is ruptured on one chamber 32 at the lead end, and the projectile 22 has been spent or fired from the gun 10. The clip 15 can then be removed from the gun 10 until another implant is desired, and the remaining chambers 20 will remain aseptically sealed. In the alternative, the clip 15 can remain in the gun and the user can continue to fire additional bullets 22.

This process of pumping the gun 10 to transversely advance the clip 15 and pulling the trigger continues until all fifteen projectiles 22 in the fifteen corresponding chambers 20 have been released. The clip 15 further includes a blocked chamber 14 which is aligned with the bore of the gun 10 after the projectile from the final working chamber 20 has been released and the user pumps the gun 10. A recess 31 corresponding to the blocked chamber 14 is the indexing means which aligns the blocked chamber 14 with the bore of the gun 10. The bolt then hits or engages the blocked chamber 14 rather than one of the working chambers 20 containing a projectile 22. The blocked chamber 14 acts as a stop against the bolt and prevents further operation of the gun 10. The operator thereby becomes immediately aware of the fact that the clip 15 no longer has any projectiles 22, and knows that it is time to reload the gun with a full clip 15. The blocked chamber 14 contains a plurality of tabs 30 which preferably extend longitudinally through the blocked chamber 14. The tabs 30 in the blocked chamber 14 are preferably integrally formed with the clip structure 15.

While the preferred form of the firearm for launching or "shooting" the projectile 22 into the animal uses compressed gas, preferably air, it is understood that the gun 10 may use other launching devices such as an expanded gas similar to explosive charges.

The molded structure 15 is preferably translucent to permit inspection of the projectiles 22, which are formed of a material having a distinct color, preferably not including reds, to color code various biologically active materials. This coating avoids possible confusion when implanting different materials at substantially the same period of time.

It is to be understood that even though numerous characteristics and advantages of the invention has been set forth in the foregoing description together with detailed of the structure and function of the invention, this disclosure is illustrative only and changes may be made in detail, especially in matters of shape, size and arrangement of parts, within the principles of the invention, to the full extent indicated by the broad general means of the appended claims.

I claim:

1. A clip for supplying hygienic projectiles to a ballistic implant gun, said clip comprising:

(a) a rectangular structure having a plurality of chambers with parallel axes, each chamber being capable of separately storing a hygienic projectile;

(b) indexing means associated with each of said chambers for aligning said chambers with a firing chamber in said gun and for indexing said chambers consecutively after each said projectile has been fired from said gun; and (c) stopping means for preventing further operation of said gun when said chambers are empty, said stopping means comprising:

(i) a blocked chamber on one end of said clip, proximate a final working chamber which is capable of storing a hygienic projectile; and (ii) indexing means for indexing said rectangular structure beyond said final working chamber wherein said blocked chamber is aligned with said firing chamber to prevent further operation of said gun when said chambers are empty.

2. A clip according to claim 1, wherein said rectangular structure includes fifteen chambers.

3. A clip according to claim 1, wherein said blocked chamber comprises a chamber having a plurality of tabs integrally formed within said wall.

4. A clip according to claim 3, wherein said tabs of said blocked chamber are positioned transversely of said rectangular structure and parallel with said chambers.

5. A clip for supplying hygienic projectiles to a ballistic implant gun, said clip comprising:

(a) a rectangular structure having a plurality of working chambers with parallel axes, each working chamber being capable of separately storing a projectile, said structure further including at least one blocked chamber;

(b) indexing means associated with each of said working chambers for aligning said chambers with a firing chamber in said gun and for indexing said chambers sequentially after each projectile has been fired from said gun;

(c) indexing means for indexing said rectangular structure beyond a final working chamber, wherein said blocked chamber is aligned with said firing chamber to prevent further operation of said gun when said working chambers are empty.

6. A clip according to claim 5 wherein said rectangular structure is formed of polyethylene.

7. A clip according to claim 5, further comprising a mechanically rupturable sealing film at each end of each of said chambers for individually isolating each of said chambers from the ambient emvironment, whereby a device in said gun may penetrate said sealing film at one end of a chamber and force said projectile through said sealing film and out said chamber at the other end of said chamber.

8. A clip according to claim 7, wherein said sealing film is a laminate of polyester and polyethylene.

9. A clip according to claim 5, wherein said structure comprises a web having said chambers positioned on one surface transversely thereof and said indexing means comprises a plurality of recesses, each recess associated with each of said working and blocked chambers.

10. A clip according to claim 7, wherein said structure is formed of a gas and moisture impermeable material and said sealing means comprises a rupturable metal foil bonded to said structure around the end of each chamber.

11. A clip according to claim 7 wherein said rectangular structure includes fifteen chambers.

12. A clip according to claim 7, wherein said blocked chamber comprises a chamber having a plurality of tabs integrally formed with said wall.

13. A clip according to claim 7, wherein said tabs of said blocked chamber are positioned transversely of said rectangular structure and parallel with said chambers.

14. A method of shooting hygienic projectiles from a ballistic implant gun which comprises the steps of:

(a) selecting a clip having a plurality of chambers, a plurality of consecutive chambers each containing a projectile;
(b) operatively connecting said clip to a guide chamber in said gun;
(c) aligning a first of said chambers with a firing chamber of said gun;
(d) transferring a projectile from said first chamber to said firing chamber;
(e) firing said projectile from said gun;
(f) continuing to advance said clip and fire said projectiles until all available projectiles have been discharged; and
(g) advancing said clip to align a stop mechanism with said firing chamber, wherein said stop mechanism comprises a blocked chamber, whereby further operation of said gun is prevented when said chambers are empty.

* * * * *

UNITED STATES PATENT AND TRADEMARK OFFICE

CERTIFICATE OF CORRECTION

PATENT NO. : 4,771,757

DATED : September 20, 1988

INVENTOR(S) : Martin A. Chevalier

It is certified that error appears in the above-identified patent and that said Letters Patent is hereby corrected as shown below:

In item number [54], the title, "CLIP WITH BLOCKED CHAMBER STOP MECHANISM FOR SUPPLYING PROJECTILES GUN" should read --CLIP WITH BLOCKED CHAMBER STOP MECHANISM FOR SUPPLYING PROJECTILES TO GUN"

In column 1, line 4, before the word "GUN" insert --TO--.

In column 3, line 30, please delete "distrubing" and substitute therefor --disturbing--.

In column 3, line 35, after "obtained", insert --by its use, reference should be had to the drawings which--.

In column 3, line 68, please delete "surfgace" and substitute therefor --surface--.

Signed and Sealed this

Eleventh Day of July, 1989

*Attest:*

*Attesting Officer*

DONALD J. QUIGG

*Commissioner of Patents and Trademarks*